United States Patent [19]

Schonbach

[11] Patent Number: 4,828,189

[45] Date of Patent: May 9, 1989

[54] ROLLER MILL FOR COMMINUTING SOLID MATERIALS

[75] Inventor: Bernard H. Schonbach, Allentown, Pa.

[73] Assignee: Fuller Company, Bethlehem, Pa.

[21] Appl. No.: 216,062

[22] Filed: Jul. 7, 1988

[51] Int. Cl.[4] ..... B02C 15/14

[52] U.S. Cl. ..... 241/121

[58] Field of Search ..... 241/117-121, 241/37, 285 R, 268, 269

[56] References Cited

U.S. PATENT DOCUMENTS

| | | | |
|---|---|---|---|
| 3,044,717 | 7/1962 | Tollow | 241/121 |
| 4,339,086 | 7/1982 | Brundiek | 241/121 |
| 4,694,997 | 9/1987 | Schonbach | 241/117 |

FOREIGN PATENT DOCUMENTS

| | | | |
|---|---|---|---|
| 1011252 | 4/1983 | U.S.S.R. | 241/121 |

*Primary Examiner*—Mark Rosenbaum

*Attorney, Agent, or Firm*—Frank H. Thomson

[57] ABSTRACT

An improved vertical roller mill for comminuting solid materials which includes a horizontal grinding table and cooperating grinding rollers and an improved apparatus for exerting a downward force on the grinding roller. This apparatus includes an external hydraulic piston-cylinder force exerting apparatus with a pair of link members external to the mill with a first link member in tension and a second link member in compression. The compression link is pivotally connected to the mill body and the force exerting apparatus and the tension link is pivotally connected to the force exerting means so that when the cylinder of the piston cylinder means moves down, the linkage mechanism results in a downward force on the grinding roll.

6 Claims, 3 Drawing Sheets

ROLLER MILL FOR COMMINUTING SOLID MATERIALS

BACKGROUND OF THE INVENTION

This invention relates to a vertical roller mill of the type used for comminuting solid materials such as coal, cement raw meal, cement clinker and ores. More particularly, the invention relates to an improved apparatus for exerting a downward force on the grinding roller of such a roller mill.

The invention is directed to a vertical roller mill which includes a casing or mill body with a horizontal grinding table mounted for rotation about a vertical axis positioned within that casing. Suitable drive means such as a motor and gear reducer are provided for rotating the table. One or more rollers are also mounted in the casing for rotation about an axis which is at some angle to the table. A downward force is exerted on the roller so that a bed of material on the table will have compressive and shear forces applied to the material to thereby comminute the material. Various means may be provided for removing the material from the table such as air which flows through the mill to lift the fine ground material up to the top of the casing where an air classifying device allows the fine particles to exit through the top of the mill and coarse particles to be recirculated back to the table. Other mills of this type include an overflow discharge for material so that material is discharged from the bottom of the mill and mechanically conveyed to a separator. Mills of the type to which the present invention relates are shown for example in U.S. Pat. Nos. 4,218,023 issued Aug. 19, 1980; 4,339,086 issued July 13, 1982; 4,694,997 issued Sept. 27, 1987; 4,382,558 issued May 10, 1983; 4,483,487 issued Nov. 20, 1984; 2,342,255 issued Feb. 22, 1944 and others.

One type of apparatus for exerting a force on the roller is shown in my prior U.S. Pat. No. 4,694,997.

Prior to the present invention, one type of a vertical roller mill known as a Loesche mill included grinding rollers mounted on one end of a pivotally mounted rocker arm assembly. This assembly is pivoted approximately its mid-point. A hydraulic piston-cylinder apparatus within the roller mill housing pulls on the other end of the rocker arm so that the rocker arm pivots about its connection to the mill body and a downward force is exerted on the grinding roll. This arrangement is shown in the aforesaid U.S. Patents including my own prior patent.

Prior designs result in congestion inside the mill stand and mill body making details and assembly difficult. The mechanical advantage of the prior design is limited thus requiring a large diameter hydraulic piston cylinder or force exerting means.

SUMMARY

It is the principal object of this invention to provide an improved roller mill for comminuting solid material such as coal, ores and cement clinkers which includes an improved apparatus for exerting a downward force on the roller of the roller mill which simplifies construction of the mill.

It is a further object of this invention to provide an improved roller mill and apparatus for exerting a downward force on the roller of that mill which permits improved design of the air supply to the mill.

In general, the foregoing and other objects will be carried out by providing an improved roller mill for comminuting solid materials comprising a mill body, a generally horizontal grinding table mounted in said mill body for rotation about a vertical axis, at least one grinding roller mounted in said body for rotation about an axis which is at an angle to the axis of rotation of the grinding table for cooperation with said grinding table for comminuting a bed of material between the grinding table and the grinding roller, a rocker arm mounted for pivotal movement relative to said grinding table, said grinding roller being mounted on one end of said rocker arm and apparatus for exerting a downward force on the grinding roller including force exerting means; a first link member pivotally connected at its one end to the other end of said rocker arm and pivotally connected at its other end to said force exerting means, and a second link member pivotally connected at its one end to said mill body and pivotally connected at its other end to said other end of said first link member and said force exerting means.

The improved apparatus for exerting a downward force on the roller of a roller mill offers the following and other advantages.

1. There is no congestion inside the mill stand making the details and assembly of the apparatus more economical.

2. The mechanical advantage of the linkage of the present invention allows the hydraulic cylinder used for exerting the downward force to be smaller in diameter.

3. With the design of the present invention, the importance of the exact location and mounting of the force exerting means is reduced.

4. The foundation and mounting for the hydraulic piston-cylinder used for generating the downward force to be applied to the grinding roll can be separate from the mill base thereby making the mill base smaller and less complicated.

5. The rocker arm which pivotally connects the roller to the mill body can be shortened to allow the gas channel for supplying air to the inside of the mill to be deeper to provide better gas flow distribution.

6. The accumulator used for absorbing small pressure variations in the hydraulic system can be mounted directly on the hydraulic piston-cylinder to eliminate or reduce the hydraulic connections required.

7. The piston-cylinder means for generating grinding forces and associated linkage systems become more accessible for maintenance as compared with prior art designs.

8. The linkage and pin arrangement connecting the hydraulic cylinder for exerting the downward force and the rocker arm lever can tolerate some misalignment making assembly and construction more economical.

It should be noted that the prior art includes piston-cylinder arrangements mounted external to the mill body for the purpose of swinging the grinding roller out of the mill body for maintenance purposes; see generally U.S. Pat. No. 4,432,500.

BRIEF DESCRIPTION OF THE DRAWINGS

The invention will be described in connection with the annexed drawings wherein.

DESCRIPTION OF THE PREFERRED EMBODIMENT

Figure 1:
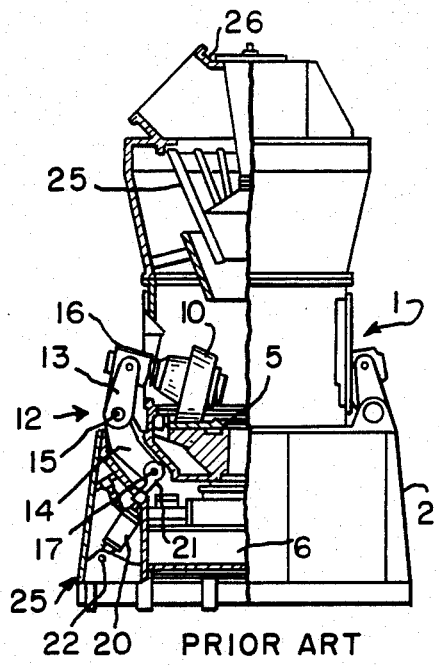
FIG. 1 is an elevation view partly in sections of a vertical roller mill according to the prior art.
Figure 2:
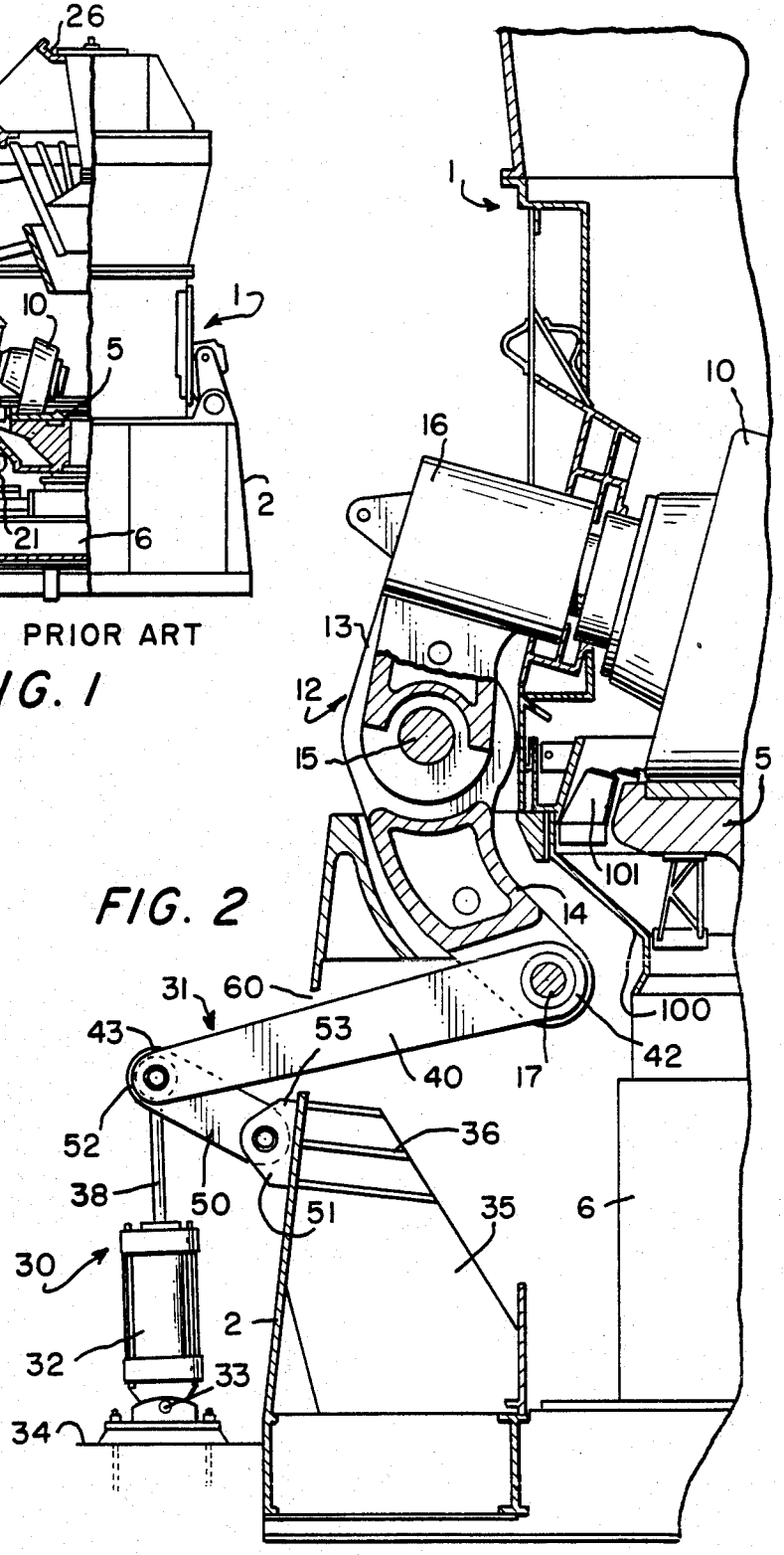
FIG. 2 is an elevation view partly in section showing a portion of a roller mill of the type shown in FIG. 1 illustrating the improvement according to the present invention.

The present invention relates to a vertical roller mill of the type shown in FIG. 1 and includes a mill body generally indicated at 1 mounted on a mill stand 2 which forms part of the mill body 1 and mounted on a suitable foundation not shown. The mill body of the prior art may be assembled from a plurality of mill stands, one for each grinding roller assembly in a manner illustrated for example in U.S. Pat. No. 3,882,829 issued July 9, 1974. The roller mill includes a horizontal grinding table 5 mounted for rotation about a vertical axis. The table 5 may be suitably connected to a drive motor (not shown) through a gear reducer 6.

The mill also includes at least one and preferably two, three or four grinding rollers 10 each mounted for rotation about an axis which is at an angle to the table 5 and in the embodiment shown is at an acute angle to the horizontal but may be mounted for rotation on a horizontal axis. A rocker arm generally indicated at 12 is pivotally mounted on the frame or mill body at 15. The rocker arm may be of a two piece configuration such as illustrated for example in U.S. Pat. No. 4,432,500 issued Feb. 21, 1984 including an upper part 13 and a lower part 14. The roller 10 is mounted on one end 16 of the rocker arm 12. The apparatus includes a hydraulic piston-cylinder means 20 with the piston rod 21 pivotally connected to the other end 17 of the rocker arm 12. This hydraulic piston-cylinder 20 is suitably connected to a source (not shown) of hydraulic fluid under pressure and may have an accumulator in the line to remove small variations in pressure which may be encountered due to variations in the feed size of the rock. Such an accumulator is generally known in the art and need not be described. The piston cylinder is pivotally connected at 22 to the mill body and mill stand 2. As hydraulic fluid is supplied to the cylinder 20, it will generate a force urging piston rod 21 downwardly so that the rocker arm assembly 12 pivots about point 15 exerting a downward force on the roller 10. The roller 10 cooperates with the grinding table 5 so that a bed of material on the table 5 is comminuted by compression and shear forces applied by the downward force and rotary motion of the rollers.

Air or gas under pressure may be supplied through a channel 100 in the mill stand 2 and mill body 1 and specifically louver ring 101 to airsweep the table 5 and lift fine material up through the mill body to an air classifier 25 mounted in the top of the mill body 1. This classifier 25 is generally known in the art and need not be described in detail. An outlet 26 for gas and entrained fine materials is provided in the top of the mill 1. Coarse material rejected by the classifier is returned to the table 5 for further grinding. It is also known in the art to have a mechanical overflow from table 5 so that coarse material is discharged from the bottom of the mill and mechanically recirculated to an internal or external classifier; see for example U.S. patent application Ser. No. 07/037,073 filed Apr. 12, 1987.

Referring to FIGS. 2 through 5, the mill of the present invention also includes a mill stand 2 forming part of a mill body 1. In this case, the use of separate box frames for each roller could if desired be eliminated. With the present invention the mill stand 2 can be a simple mechanical construction supported by reinforcing members 35 and gusset plates 36. A horizontal grinding table 5 is mounted in the mill body and grinding rollers 10 connected to a rocker arm assembly 12 pivotally mounted at 15 to the frame or mill body. The rollers 10 are mounted at one end 16 of the arm 12 for rotation about an axis which is at an angle to the axis of rotation of grinding table 5. The rocker arm in this invention may also be formed of two pieces as illustrated at 13 and 14. A means 30 for exerting a downward force on the roller 10 through the mechanism 12 is provided. In this case, the apparatus for exerting a downward force on the roller 10 is at least partially mounted external to the mill stand 2 and connected by suitable linkage means 31 to the rocker arm 12.

The improved apparatus 30 for exerting a downward force on the roller 10 includes an externally mounted hydraulic piston cylinder or force exerting means 32 pivotally connected at its bottom 33 to the foundation 34 separate from the mill body 2. It should be noted that the means 30 for generating a force may be other apparatus such as mechanical springs without diverting from the concepts of the present invention.

The linkage means 31 includes a first link member 40 pivotally connected at its one end 42 to the other end 17 of rocker arm 12 and pivotally connected at its other end 43 to the piston rod 38 of the force exerting means 32. A second link member or tension link 50 is pivotally connected at its one end 51 to the mill body 2 at the plate 35 as shown at 53. The second link member 50 is pivotally connected at its other end 52 of the other end 43 of the first link member 40 and to the force exerting means 32, namely the piston rod 38. The link member 32 extends through an opening 60 in the mill body 2 which is sufficiently large to permit free movement of the linkage 31; see FIG. 4. Each of the links and pivot points are arranged to permit movement in a vertical plane. The link member 40 is a tension link and the link member 50 is a compression link.

If it is desired to exert a downward force on roller 10, hydraulic fluid under pressure is supplied from a source (not shown) to the upper end of the piston cylinder means 32 to exert a downward force on piston 38. This causes link member 50 to pivot about its one end 51 and cause a downward and outward movement of first link 40 so that the lever arm 12 pivots to the left in FIG. 2 about point 15. This pivotal movement of rocker arm 12 exerts a downward force on roller 10. As the downward force on the piston 38 and consequently roller 10 is increased, the grinding forces on the bed of material increase.

As can be seen from drawings with the present invention, if there is misalignment between the piston cylinder means 32 and the link 40 and 50, this misalignment can be properly adjusted for.

Figure 3:
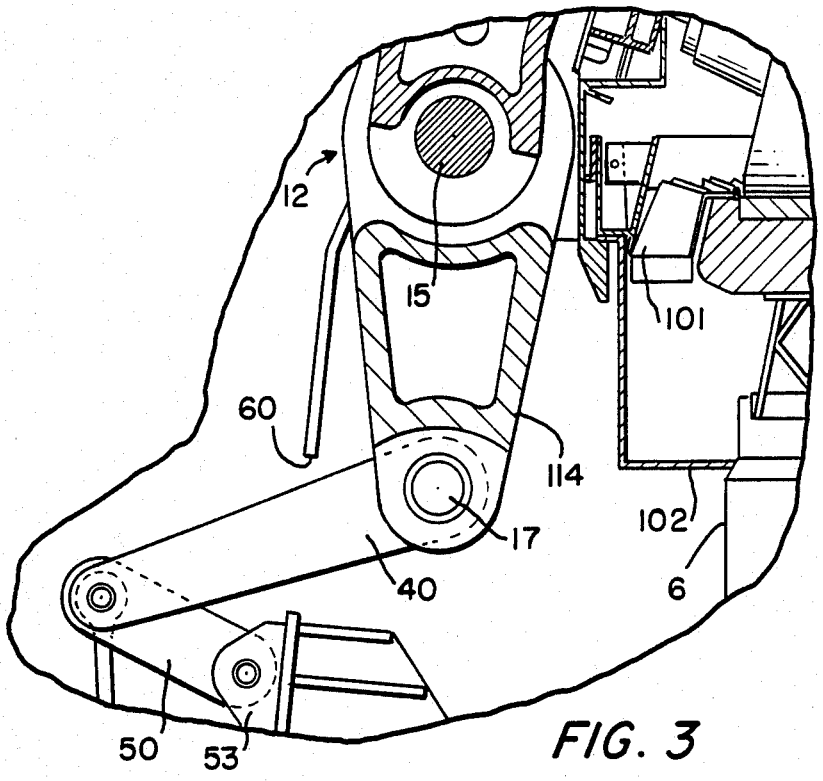
FIG. 3 is a fragmentary sectional view of a modified embodiment of the present invention.

The improved apparatus of the present invention also permits a redesign of the lever arm 12 as shown in FIG. 3. In this embodiment, the lower part of the lever arm 12 is straight at 114 as compared to the curved section 14 shown in FIG. 2. In this arrangement, the channel 102 can be deeper than the channel 100 in FIG. 2 to thereby improve the supply of air under pressure up through louver ring 101 (Feb. 2) for supplying air under pressure to the inside of the mill one for lifting fine material up to the classifier 20.

Figure 5:
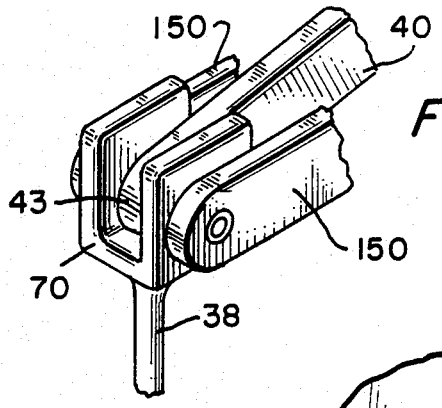
FIG. 5 is a perspective view of a modified embodiment of a portion of the present invention.
Figure 4:
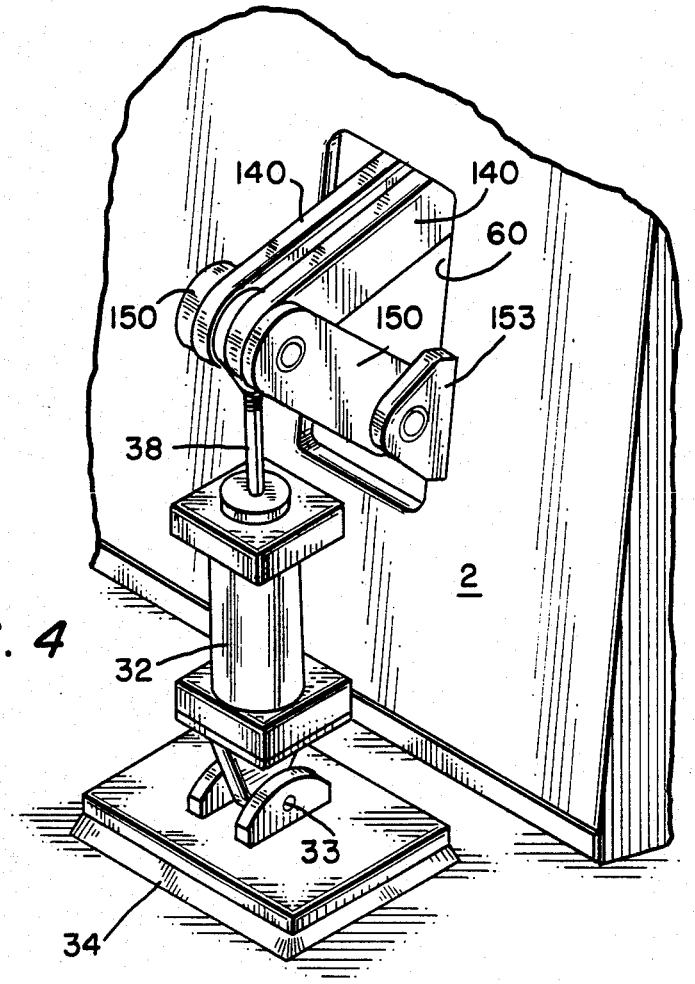
FIG. 4 is a perspective view of a portion of an embodiment of the present invention similar to that shown in FIG. 2.

Referring to FIGS. 4 and 5, there is shown the link members 40 and 50 wherein two second link members 150 may each be connected to member 153 in the mill stand 2 on opposite sides of opening 60. A pair of first link members 140 and the piston rod 38 may be sandwiched between the links 150.

In FIG. 5 there is a clevis 70 connected to piston rod 38. The link member 40 is mounted on the inside of the clevis and a pair of link members 150 are pivotally mounted on the outside of the clevis 70.

From the foregoing it can be seen that a novel apparatus for exerting a downward on the roller of a vertical roller mill has been provided. This arrangement provides a novel link arrangement to improve the positioning and carry out the improvements and advantages set forth herein. It is intended that the foregoing be a description of a preferred embodiment and that the invention be limited solely by that which is within the scope of the impended claims.

I claim:

1. An improved roller mill for comminuting solid materials comprising a mill body, a generally horizontal grinding table mounted in said mill body for rotation about a vertical axis, at least one grinding roller mounted in said body for rotation about an axis which is at an angle to the axis of rotation of the grinding table for cooperation with said grinding table for comminuting a bed of material between the grinding table and said at least one grinding roller, a rocker arm mounted for pivotal movement relative to said grinding table, said at least one grinding roller being mounted on one end of said rocker arm and apparatus for exerting a downward force on said at least one grinding roller including force exerting means, a first link member pivotally connected at its one end to the other end of said rocker arm and pivotally connected at its other end to said force exerting means, and a second link member pivotally connected at its one end to the mill body and pivotally connected at its other end to said other end of said first link member and said force exerting means.

2. An improved roller mill for comminuting solid material according to claim 1 wherein said force exerting means is mounted external to said mill body.

3. An improved roller mill for comminuting solid material according to claim 2 wherein said force exerting means is a hydraulic piston-cylinder means pivotally mounted at its base.

4. An improved roller mill for comminuting solid material according to claim 3 wherein said first link and said second link are each pivotally connected at their respective other ends to the piston-cylinder means by a pivot pin external to said mill body.

5. An improved roller mill for comminuting solid material according to claim 4 wherein said piston-cylinder means includes a clevis and said first link is mounted within sid clevis and said second link includes a pair of link arms on the outside of said clevis.

6. An improved roller mill for comminuting solid material according to claim 2 wherein said first link member is connected to said force exerting means and said second link member is connected to said force exerting means each for pivotal movement in a vertical plane whereby a downward force exerted by the force exerting means causes the first and second links to pivot and the rocker arm to pivot relative to said grinding table so that a downward force is exerted on the grinding roll.

* * * * *